US006283207B1

(12) United States Patent
Lemetayer

(10) Patent No.: US 6,283,207 B1
(45) Date of Patent: Sep. 4, 2001

(54) METHOD FOR CONTROLLING A HYDROCARBONS PRODUCTION WELL OF THE GUSHING TYPE

(75) Inventor: Pierre Lemetayer, Pau (FR)

(73) Assignee: Elf Exploration Production (FR)

( * ) Notice: Subject to any disclaimer, the term of this patent is extended or adjusted under 35 U.S.C. 154(b) by 0 days.

(21) Appl. No.: 09/398,463

(22) Filed: Sep. 17, 1999

(30) Foreign Application Priority Data

Sep. 21, 1998 (FR) ..... 98 11729

(51) Int. Cl.[7] ..... E21B 43/12
(52) U.S. Cl. ..... 166/250.15; 166/53; 166/369
(58) Field of Search ..... 166/250.01, 250.15, 166/369, 370, 373, 374, 53

(56) References Cited

U.S. PATENT DOCUMENTS 4,481,503 11/1984 Lehman et al. ..... 340/518
4,615,390 * 10/1986 Lucas et al. ..... 166/250.01
4,721,158 1/1988 Merritt, Jr. et al. ..... 166/250.01
6,119,781 * 9/2000 Lemetayer et al. ..... 166/369
6,158,508 * 12/2000 Lemetayer et al. ..... 166/250.15

FOREIGN PATENT DOCUMENTS 2151047 7/1985 (GB) .
2188451 9/1987 (GB) .

* cited by examiner

*Primary Examiner*—William Neuder
(74) *Attorney, Agent, or Firm*—Blank Rome Comisky & McCauley, LLP

(57) ABSTRACT

A method for controlling a gushing hydrocarbon production well is disclosed which utilizes a variable aperture outlet choke and a control system to dampen and minimize the effect of liquid and gas plugs flowing through the system.

17 Claims, 2 Drawing Sheets

METHOD FOR CONTROLLING A HYDROCARBONS PRODUCTION WELL OF THE GUSHING TYPE

DESCRIPTION

1. Technical Field

The present invention relates to a method for controlling a liquid and gaseous hydrocarbons production well of the gushing type which feeds a downstream treatment unit.

2. State of the Prior Art

A known process for controlling the production flow rate of an oil well of the gushing type which comprises a hydrocarbons production column connecting the bottom of the well to a wellhead, connected by a pipe through a variable-aperture outlet choke to a downstream unit for treating the produced hydrocarbons, consists in positioning the outlet choke to set value so as to obtain a given produced-hydrocarbons flow rate.

This process does not allow effective control over the production of the hydrocarbons when plugs of gas form when the well starts production, as a result of the opening of the outlet choke, or when alternating plugs of gaseous and of liquid hydrocarbons occur, which plugs may be formed particularly in wells which have long drains with shallow, negative and varying gradients.

These plugs disrupt the production of hydrocarbons and this is manifested in an irregular supply to the downstream treatment units, such as liquid/gas separation units, or units for recompressing and processing the gas.

This irregular supply to the downstream treatment units has the following consequences:

- it reduces the amount of gas that can be recompressed to be reinjected into the well or for sale,
- it increases the wear on the equipment of these units, and
- it increases the risks of tripping, which is manifested in a reduction in production.

Another consequence of these disturbances is an accentuation of the wear on the hole layer connection, particularly in wells sunk into unconsolidated reservoirs, and this leads to the ingress of sand which requires the installation of expensive sand-control equipment which may reduce the production capacity of the well or lead to frequent and expensive restoration of damaged wells.

Something else which this method is unable to provide is control over the initiation of a preferred flow of gas or water towards the bottom of the well from a zone of the reservoir which has been invaded by hydrocarbons in the gaseous form or by water.

Nor is it able to effectively compensate for the disruptions which result from the random behaviour of the reservoir, or for failure of the production column equipment.

The present invention is intended precisely to overcome these drawbacks, and to this end it provides a method for controlling a liquid and gaseous hydrocarbons production well of the gushing type, the well comprising at least one production column extended at its upper part by an outlet pipe for the produced hydrocarbons and fitted with variable-aperture means of controlling the hydrocarbons flow rate, the method being characterized in that it comprises a start-up phase which consists in performing the following sequence of steps:

- a step of initiating hydrocarbons production which consists:
  - in gradually opening the control means to a predetermined value so as to achieve a predetermined minimum produced-hydrocarbons flow rate,

- in comparing the hydrocarbons flow rate with a predetermined threshold and if the said flow rate exceeds the said threshold, in suspending the opening of the control means for the duration that the threshold is exceeded,
- a step of ramping up to production speed which consists in performing the following operations:
  - comparing the produced-hydrocarbons flow rate with a predetermined threshold T1 and if the said flow rate exceeds the said threshold continuously for a predetermined length of time D1, in increasing the aperture of the control means to a predetermined value, otherwise repeating the comparison,
  - waiting for a predetermined length of time to allow the minimum hydrocarbons flow rate to become established,
  - comparing the produced-hydrocarbons flow rate with a threshold T2 higher than T1 and comparing the pressure upstream of the control means with a predetermined threshold P1 and if the said flow rate and the said pressure simultaneously exceed the said thresholds continuously for the length of time D1, in finishing the start-up phase, otherwise repeating the comparison.

According to another feature, the method of the invention additionally consists in periodically performing the following operations:

- calculating the derivative with respect to time of the pressure upstream of the means for controlling the produced-hydrocarbons flow rate,
- comparing this derivative with a predetermined negative threshold and with a predetermined positive threshold and if the derivative of the pressure is below the negative threshold or if the said derivative is above the positive threshold, in suspending the opening of the means for controlling the produced-hydrocarbons flow rate.

According to another feature of the invention, the start-up phase additionally consists in performing the following operations:

- calculating a well demand criterion,
- comparing this criterion with a predetermined threshold, if the criterion exceeds this threshold, suspending the opening of the means for controlling the produced-hydrocarbons flow rate.

According to another feature of the invention, the start-up phase is followed by a production phase which consists in performing the following operations:

- defining a production indicator,
- comparing the production indicator with two predetermined thresholds S1, S2, S2 being higher than S1, and:
  - a) if the production indicator is below S1, and if the aperture of the means for controlling the produced-hydrocarbons flow rate is below a predetermined threshold, in increasing the aperture of the said control means by a predetermined amount,
  - b) if the production indicator is above S2, and if the aperture of the means for controlling the produced-hydrocarbons flow rate is above a predetermined threshold, in reducing the aperture of the said control means by a predetermined amount,
  - c) in repeating the previous comparison,
- comparing the produced-hydrocarbons flow rate with a predetermined threshold and if the said flow rate is below the said threshold, in closing the produced-hydrocarbons control means for a predetermined length of time and in resuming the start-up phase.

According to another feature of the invention, the start-up phase is followed by a production phase which consists in performing the following operations:

defining two production indicators Qa and Qb, comparing these two indicators Qa and Qb with, respectively, two pairs of predetermined thresholds Sa1, Sa2 and Sb1, Sb2, Sa2 being higher than Sa1 and Sb2 being higher than Sb1:

a) if Qa is below Sa1 and if Qb is below Sb1 and if the aperture of the means for controlling the produced-hydrocarbons flow rate is below a predetermined threshold, in increasing the aperture of the said control means by a predetermined amount b) if Qa is above Sa2 and if Qb is above Sb2 and if the aperture of the means for controlling the produced-hydrocarbons flow rate is above a predetermined threshold, in reducing the aperture of the said control means by a predetermined amount, c) in repeating the previous comparison, comparing Q1 and Q2 with, respectively, two predetermined thresholds S1 and S2 and if Q1 is below S1 or if Q2 is above S2, in closing the means for controlling the produced-hydrocarbons flow rate for a predetermined length of time and in resuming the start-up phase.

According to another feature of the invention, with the produced liquid hydrocarbons containing water, at least one production indicator is the flow rate of the said hydrocarbons.

According to another feature of the invention, with the produced liquid hydrocarbons containing water, at least one production indicator is the flow rate of liquid hydrocarbons without water.

According to another feature of the invention, with the produced liquid hydrocarbons containing water, at least one production indicator is the water flow rate.

According to another feature of the invention, at least one production indicator is the flow rate of produced gaseous hydrocarbons.

According to another feature of the invention, the production phase additionally consists in performing the following operations:

calculating a well demand criterion comparing this criterion with a predetermined threshold, if the criterion exceeds this threshold, in reducing the aperture of the means for controlling the produced-hydrocarbons flow rate by a predetermined amount.

According to another feature of the invention, the demand criterion is calculated from a physical parameter measured on the well.

According to another feature of the invention, the means for controlling the produced-hydrocarbons flow rate comprise an outlet choke arranged on the outlet pipe.

According to another feature of the invention, with the production column extended at its lower part by at least one hydrocarbons collection drain, the means for controlling the produced-hydrocarbons flow rate comprise at least one automatic bottom valve arranged on at least one drain.

According to another feature of the invention, the means for controlling the produced-hydrocarbons flow rate additionally comprise an outlet choke arranged on the outlet pipe.

According to another feature of the invention, the produced-hydrocarbons flow rate is measured by means of a flow meter mounted on the outlet pipe.

According to another feature of the invention, the produced-hydrocarbons flow rate is estimated from a measurement of the produced-hydrocarbons temperature in the outlet pipe.

According to another feature of the invention, the produced-hydrocarbons flow rate is estimated from the pressure difference across the means for controlling the produced-hydrocarbons flow rate and from the aperture of the said means.

BRIEF DESCRIPTION OF THE DRAWINGS

The invention will be better understood from reading the following description which is given by way of example with reference to the appended drawings, in which.

DETAILED DESCRIPTION OF THE INVENTION

In general, the method of the invention is used to control a hydrocarbons production well which supplies downstream treatment units.

Figure 1:
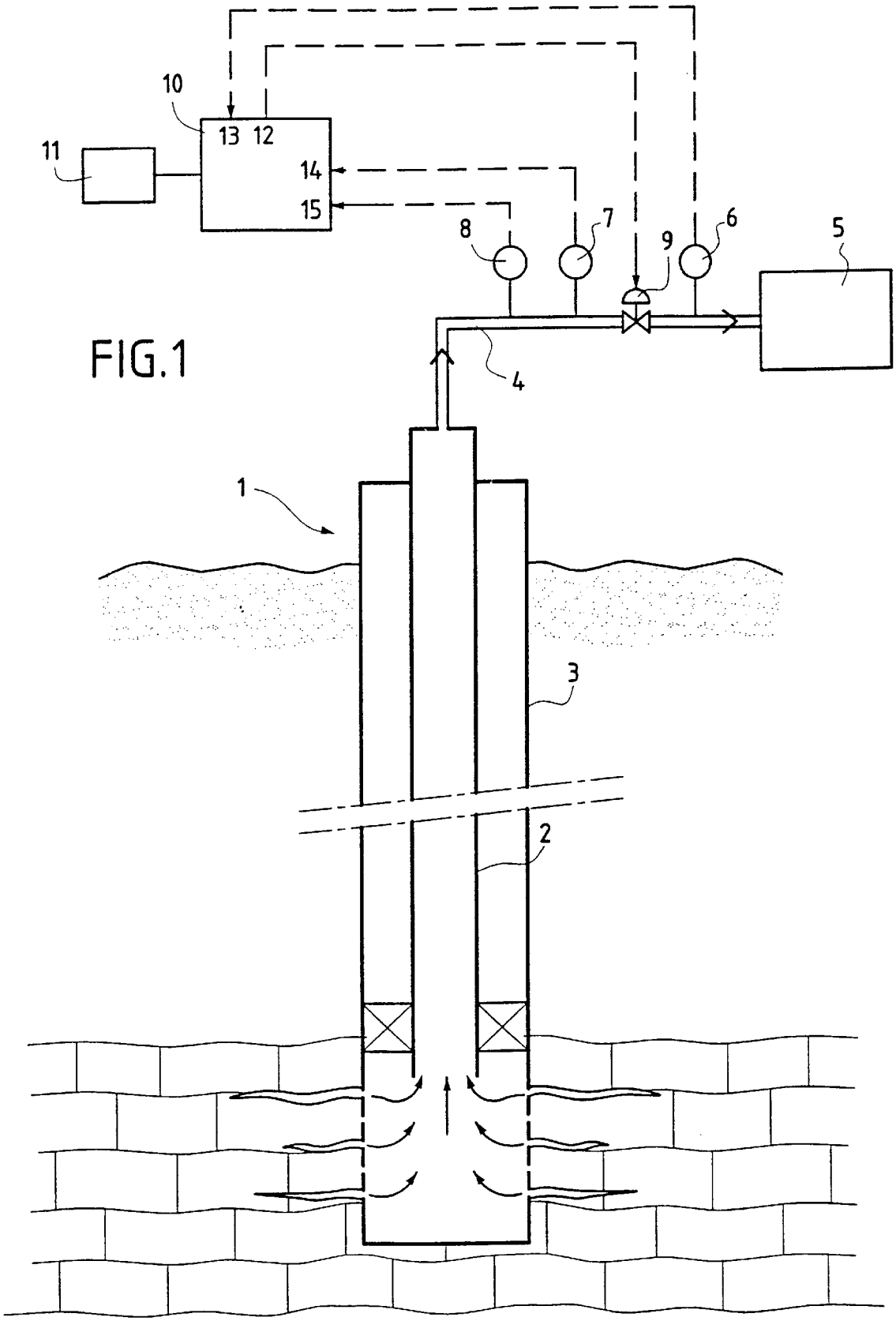
FIG. 1 diagrammatically depicts a hydrocarbons production well of the gushing type, fed by a single reservoir, FIG. 2 diagrammatically depicts a hydrocarbons production well of the gushing type comprising two production drains fed by two reservoirs.

FIG. 1 depicts a well 1 for producing hydrocarbons in the form of a mixture of liquid and gas of the gushing type, which comprises:

a production column 2, a casing 3 surrounding the column 2, a downstream unit 5 for processing the hydrocarbons produced, an outlet pipe 4 for the produced hydrocarbons, connecting the upper part of the column 2 to the downstream treatment unit 5 through a controllable variable-aperture outlet choke 9 forming means for controlling the produced-hydrocarbons flow rate, a sensor 6 for measuring pressure downstream of the choke 9, which delivers an electronic signal which represents this pressure, a sensor 7 for measuring the temperature upstream of the choke 9, which delivers an electronic signal which represents this temperature, a sensor 8 for measuring the pressure upstream of the choke 9, which delivers an electronic signal which represents pressure, a programmable controller 10 with inputs 13, 14 and 15 which respectively receive the electronic signals delivered by the sensors 6, 7 and 8, and an output 12 which delivers a signal controlling the position of the output choke 9, means 11 for dialogue between operator and controller 10.

The controller 10 additionally comprises, and this is not depicted in FIG. 1, a memory previously loaded with a control program and with the data needed for controlling the well, particularly all the predetermined values of the adjustment variables. This data is entered beforehand by an operator using the operator/controller dialogue means 11 and can be updated during production using the same means.

Some of this data may be entered by a control-assistance computer, not depicted in FIG. 1.

Before the well 1 enters service, the outlet choke 9 is closed.

The method of the invention employed for controlling the well 1 comprises a start-up phase consisting of two steps.

A first step of initiating the production of hydrocarbons, during which step the controller 10 gradually opens the choke 9 to a predetermined value which is calculated to ensure that the produced hydrocarbons reach a predetermined minimum flow rate, for example 25% of the flow rate for which the well was designed, and compares with a predetermined threshold, for example 150% of the minimum flow rate, the hydrocarbons flow rate estimated from a temperature measurement supplied by the sensor 7, using the following formula:

$$Q=Qo+\lambda\sqrt{T-To}$$

in which:

Q represents the estimated produced-hydrocarbons flow rate,

Qo, To and λ are characteristic constants of the well,

T is the temperature of the hydrocarbons in the pipe 4 supplied by the sensor 7 if the estimated flow rate exceeds this threshold, then the controller 10 suspends the opening of the choke 9 by maintaining the control signal at its last value on the output 12 until the threshold is no longer exceeded.

Once the step of initiating the production of hydrocarbons is thus finished, the start-up phase continues with the performing of a step of ramping up to production speed, during which step the controller 10 performs the following operations.

It compares the produced-hydrocarbons flow rate, estimated as previously from the temperature measurement supplied by the sensor 7, with a predetermined threshold T1 which represents the minimum flow rate, namely, for example, 25% of the flow rate for which the well was designed.

If the estimated produced-hydrocarbons flow rate continuously exceeds the threshold T1 for a length of time D1 which is predetermined as a function of the well characteristics, for example 20 min, the controller 10 delivers on its output 12 a signal to open the choke 9 to a predetermined value, for example 30% of its maximum aperture.

Otherwise, the controller 10 repeats the previous comparison.

When the produced-hydrocarbons flow rate is practically stabilized, that is to say after waiting for a predetermined length of time that corresponds to the time taken to sweep the production column 2 and after waiting for the start of flow in the drainage area around the well, for example 60 min, the controller 10:

compares the produced-hydrocarbons flow rate estimated from the temperature measurement upstream of the choke 9 supplied by the sensor 7, with a threshold T2 higher than T1, for example 50% of the production flow rate for which the well was designed, compares the pressure upstream of the choke 9, measured by the sensor 8, with a predetermined pressure threshold P1.

If, simultaneously, the estimated produced-hydrocarbons flow rate exceeds the threshold T2 and the pressure upstream of the choke 9 exceeds the threshold P1 for a predetermined length of time, for example 20 min, the controller 10 performs the operations of the production phase.

If this double condition is not satisfied, the controller 10 repeats the comparison of the produced-hydrocarbons flow rate with the thresholds T1 and T2.

Once the start-up phase has finished, the method of the invention comprises a production phase during which the controller 10 performs the following operations:

it calculates two production indicators Qa and Qb

Qa is the produced-hydrocarbons flow rate estimated from the temperature T upstream of the choke 9, using the above formula Qb is the produced-hydrocarbons flow rate estimated from the pressure difference across the choke 9, using the following formula:

$$Q=k\times Pupstream\times[\sqrt{(Pupstream-Pdownstream)}/\sqrt{(Pupstream)}]\times S$$

if Pdownstream>0.5×Pupstream and

Q=k×Pupstream×0.707×S if Pdownstream<0.5×Pupstream in which

Q represents the estimated produced-hydrocarbons flow rate, k is a constant,

S is the passage cross-sectional area of the choke 9,

Pupstream and Pdownstream are, respectively, the pressures upstream and downstream of the choke 9, measured respectively by the sensors 8 and 6 compares the indicators Qa and Qb respectively with two thresholds ST1, ST2 and SP1, SP2.

ST1, ST2, SP1 and SP2 are predetermined as a function of the flow rate for which the well was designed, for example:

ST1=75% of the hydrocarbons flow rate for which the well was designed

ST2=90% of the hydrocarbons flow rate for which the well was designed

SP1=80% of the hydrocarbons flow rate for which the well was designed

SP2=110% of the hydrocarbons flow rate for which the well was designed.

If Qa is below ST1 and Qb is below SP1, and if the aperture of the choke 9 is below a threshold which is predetermined as a function of the well characteristics, for example 60% of the maximum aperture, the controller 10 increases the aperture of the choke 9 by a predetermined amount, for example 3% of the maximum aperture.

If Qa is above ST2 and if Qb is above SP2 and if the aperture of the choke 9 is above a threshold which is predetermined as a function of the well characteristics, for example 30% of the maximum aperture, the controller 10 reduces the aperture of the choke 9 by a predetermined amount, for example 3% of the maximum aperture.

Otherwise, the controller 10 repeats the previous operations.

In parallel, the controller 10 compares Q1 and Q2 respectively with two predetermined thresholds S1 and S2, S1 being equal to 25% of the hydrocarbons flow rate for which the well was designed and S2 being equal to 40% of the same flow rate, and if Q1 is below S1 or if Q2 is above S2, the controller 10 resumes the startup phase from its beginning.

During the start-up and production phases, the controller 10 monitors the rate at which the pressure in the pipe 4 changes upstream of the choke 9, comparing the derivative of this pressure with respect to time with a positive threshold, for example 1 bar per minute, and with a negative threshold, for example −1 bar per 5 minutes, and if the derivative of pressure does not lie between these two threshold values, the controller 10 suspends the opening of the choke 9.

During these two phases, it also calculates a well demand criterion on the basis of a physical parameter measured on the well, for example the pressure at the bottom of the well measured by means of a sensor not depicted in FIG. 1, applying the following formula:

$$C=a\times(Pstat-P)$$

in which:

C represents the demand criterion, a is a constant

Pstat represents the static pressure at the bottom of the well, that is to say the well bottom pressure in the absence of any hydrocarbons flow rate, P represents the well bottom pressure during production.

The controller 10 compares C with a threshold which is predetermined as a function of the mechanical strength characteristics of the reservoir and if this threshold is exceeded it delivers a signal to close the outlet choke 9, to for example 5% of its maximum aperture.

Other physical parameters may be used as well demand criterion, such as the sand flow rate in production, when the hydrocarbons contain sand, the pressure in the annular space defined by the production column 2 and the casing 3 which surrounds it, a temperature at some point in the well or a mechanical parameter of an item of well equipment.

By virtue of the alteration of the position of the outlet choke in accordance with the method of the invention, the first plug of gas and the first plug of liquid which occur during the start-up phase are greatly damped and production is increased gradually in a stable manner and then constantly maintained at a target value.

By virtue of the monitoring of the rate of change of pressure in the outlet pipe and of the value of a demand criterion, the risk of well damage is reduced.

Figure 2:
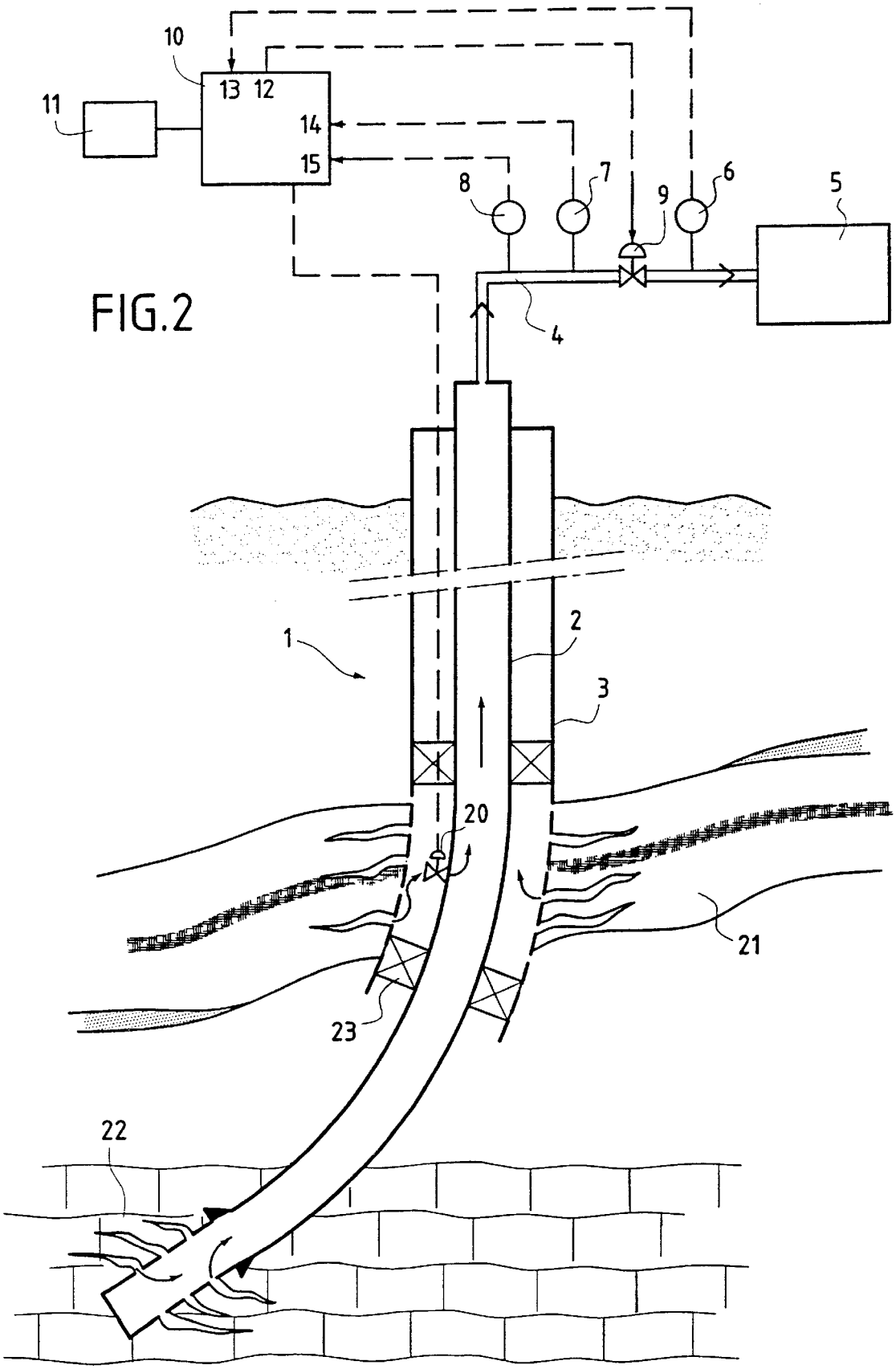

The method of the invention implemented for controlling the hydrocarbons production well described above is not restricted to the control of this type of well, it also applies, through adaptations that are within the competence of the person skilled in the art of the invention, to the control of other types of gushing well such as:

of the "multidrain" type, in which the production column is fed by several drains which pass through one or more reservoirs, of the type depicted in FIG. 2 which has two reservoir zones 21 and 22 isolated by a seal 23, and an automatic valve 20 which can be controlled from the controller 10, which valve makes it possible to alter the contribution made by the reservoir 21 to the production of hydrocarbons.

What is claimed is:

1. Method for controlling a liquid and gaseous hydrocarbons production well of the gushing type, the well comprising at least one production column extended at its upper part by an outlet pipe for the hydrocarbons and fitted with variable aperture means for controlling a hydrocarbons flow rate, the method comprising a start-up phase which comprises performing the following sequence of steps:

initiating hydrocarbons production which comprises:

(a) gradually opening the control means to a predetermined value so as to achieve a predetermined minimum hydrocarbons flow rate, (b) comparing the hydrocarbons flow rate with a predetermined minimum flow rate threshold and if the said hydrocarbons flow rate exceeds the said minimum flow rate threshold, suspending the opening of the control means for the duration that the minimum flow rate threshold is exceeded, ramping up to production speed which comprises performing the following operations:

(c) comparing the hydrocarbons flow rate with a predetermined flow rate threshold T1 and if the said flow rate exceeds the said flow rate threshold continuously for a predetermined length of time D1, increasing the aperture of the control means to a predetermined value, otherwise repeating the comparison in this step (c), (d) waiting for a predetermined length of time to allow the minimum hydrocarbons flow rate to become established, (e) comparing the hydrocarbons flow rate with a flow rate threshold T2 higher than T1 and comparing pressure upstream of the control means with a predetermined pressure threshold P1 and if the said flow rate exceeds T2 and the said pressure simultaneously exceeds P1 continuously for the length of time D1, performing the operation of a production phase, otherwise repeating the comparison of steps (c), (d) and (e).

2. Method according to claim 1, further comprising periodically performing the following operations:

calculating a derivative with respect to time of the pressure upstream of the means for controlling the produced-hydrocarbons flow rate, comparing said derivative with a predetermined negative pressure/time derivative threshold and with a predetermined positive pressure/time derivative threshold and if the derivative of the pressure is below the negative threshold or if the said derivative is above the positive threshold, suspending the opening of the means for controlling the produced-hydrocarbons flow rate.

3. Method according to claim 1 wherein the start-up phase additionally comprises performing the following operations:

calculating a well demand criterion, comparing this criterion with a predetermined demand criterion threshold, if the well demand criterion exceeds the demand criterion threshold, suspending the opening of the means for controlling the produced-hydrocarbons flow rate.

4. Method according to claim 1, wherein the start-up phase is followed by a production phase which comprises performing the following operations:

defining a production indicator, comparing the production indicator with two predetermined flow rate thresholds S1, S2, S2 being higher than S1, and:

a) if the production indicator is below S1, and if the aperture of the means for controlling the produced-hydrocarbons flow rate is below a predetermined threshold, increasing the aperture of the said control means by a predetermined amount, b) if the production indicator is above S2, and if the aperture of the means for controlling the produced-hydrocarbons flow rate is above a predetermined threshold, reducing the aperture of the said control means by a predetermined amount, c) repeating the previous comparison, comparing the produced-hydrocarbons flow rate with a predetermined flow rate threshold and if the said flow rate is below the said flow rate threshold, closing the produced-hydrocarbons control means for a predetermined length of time and resuming the start-up phase.

5. Method according to claim 1, wherein the start-up phase is followed by a production phase which comprises performing the following operations:

calculating two production indicators Qa and Qb, comparing these two indicators Qa and Qb with, respectively, two pairs of predetermined flow rate thresholds Sa1, Sa2 and Sb1, Sb2, Sa2 being higher than Sa1 and Sb2 being higher than Sb1:

a) if Qa is below Sa1 and if Qb is below Sb1 and if the aperture of the means for controlling the produced-hydrocarbons flow rate is below a predetermined threshold, increasing the aperture of the said means by a predetermined amount b) if Qa is above Sa2 and if Qb is above Sb2 and if the aperture of the means for controlling the produced-hydrocarbons flow rate is above a predetermined threshold, reducing the aperture of the said means by a predetermined amount, c) repeating the previous comparison, comparing Q1 and Q2 with, respectively, two predetermined flow rate thresholds S1 and S2 and if Q1 is below S1 or if Q2 is above S2, closing the means for controlling the produced-hydrocarbons flow rate for a predetermined length of time and resuming the start-up phase.

6. Method according to claim 4, wherein with the produced liquid hydrocarbons containing water, at least one production indicator is the flow rate of the said hydrocarbons.

7. Method according to claim 4, wherein with the produced liquid hydrocarbons containing water, at least one production indicator is the flow rate of liquid hydrocarbons without water.

8. Method according to claim 4, wherein with the produced liquid hydrocarbons containing water, at least one production indicator is the water flow rate.

9. Method according to claim 4, wherein at least one production indicator is the flow rate of produced gaseous hydrocarbons.

10. Method according to claim 4, wherein the production phase additionally comprises performing the following operations:

calculating a well demand criterion comparing this criterion with a predetermined demand criterion threshold, if the well demand criterion exceeds the demand criterion threshold, reducing the aperture of the means for controlling the produced-hydrocarbons flow rate by a predetermined amount.

11. Method according to claim 3, wherein the demand criterion is calculated from a physical parameter measured on the well.

12. Method according to claim 1, wherein the means for controlling the produced-hydrocarbons flow rate comprise an outlet choke arranged on the outlet pipe.

13. Method according to claim 1, wherein with the production column extended at its lower part by at least one hydrocarbons collection drain, the means for controlling the produced-hydrocarbons flow rate comprise at least one automatic bottom valve arranged on at least one drain.

14. Method according to claim 13, wherein the means for controlling the produced-hydrocarbons flow rate additionally comprise an outlet choke arranged on the outlet pipe.

15. Method according to claim 1, wherein the produced-hydrocarbons flow rate is measured by means of a flow meter mounted on the outlet pipe.

16. Method according to claim 1, wherein the produced-hydrocarbons flow rate is estimated from a measurement of the temperature of the produced-hydrocarbons in the outlet pipe.

17. Method according to claim 1, wherein the produced-hydrocarbons flow rate is estimated from the pressure difference across the means for controlling the produced-hydrocarbons flow rate and from the aperture of the said means.

* * * * *